United States Patent [19]

Luperti et al.

[11] Patent Number: 4,715,164

[45] Date of Patent: Dec. 29, 1987

[54] HIGH SPEED ENVELOPE FLAP OPENER

[75] Inventors: Harry E. Luperti, Bethel; Eric N. Person, Danbury; Thomas Simmel, Milford, all of Conn.

[73] Assignee: Pitney Bowes Inc., Stamford, Conn.

[21] Appl. No.: 835,000

[22] Filed: Feb. 28, 1986

[51] Int. Cl.[4] ..... B65B 43/26

[52] U.S. Cl. ..... 53/381 R; 53/266 A

[58] Field of Search ..... 53/266 A, 381 R, 382, 53/569; 493/409

[56] References Cited

U.S. PATENT DOCUMENTS

| | | | |
|---|---|---|---|
| 2,668,053 | 2/1954 | Bach | 53/381 R X |
| 2,766,569 | 10/1956 | Strother et al. | 53/266 A X |
| 3,162,435 | 12/1964 | Rastorguyeff et al. | 493/409 X |
| 3,452,504 | 7/1969 | Marshall | 53/381 R X |
| 3,568,401 | 3/1971 | Bonsch | 53/569 |
| 4,016,708 | 4/1977 | DeHart | 53/381 R |
| 4,373,848 | 2/1983 | Bishop | 53/381 R X |

*Primary Examiner*—Robert L. Spruill
*Assistant Examiner*—Steven P. Weihrouch
*Attorney, Agent, or Firm*—Lawrence E. Sklar; David E. Pitchenik; Melvin J. Scolnick

[57] ABSTRACT

In accordance with the invention, a novel high-speed flap-opening apparatus is used in combination with a relatively large transfer roller having two spaced rollers disposed along the periphery to form two separated nips. The pivotable envelope flap-opener comprises guide means having a lip for engaging the flap of the envelope. The flap-opener is disposed at a first position for receiving an envelope from the first nip. The force of the envelope causes the flap-opener to move to a second position which guides the envelope to the second nip of the envelope. As the flap emerges from the first nip, the lip of the flap-opener engages the flap to bend it back as the envelope passes through the second nip.

5 Claims, 6 Drawing Figures

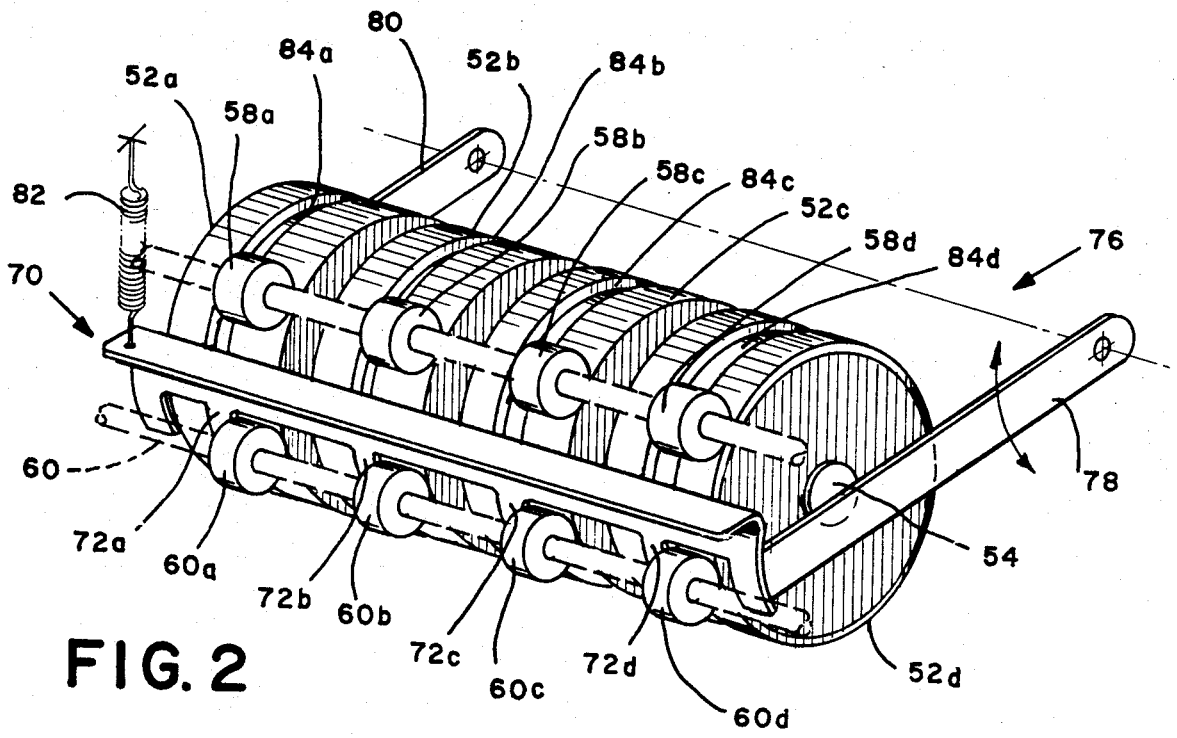
FIG. 2
FIG. 3
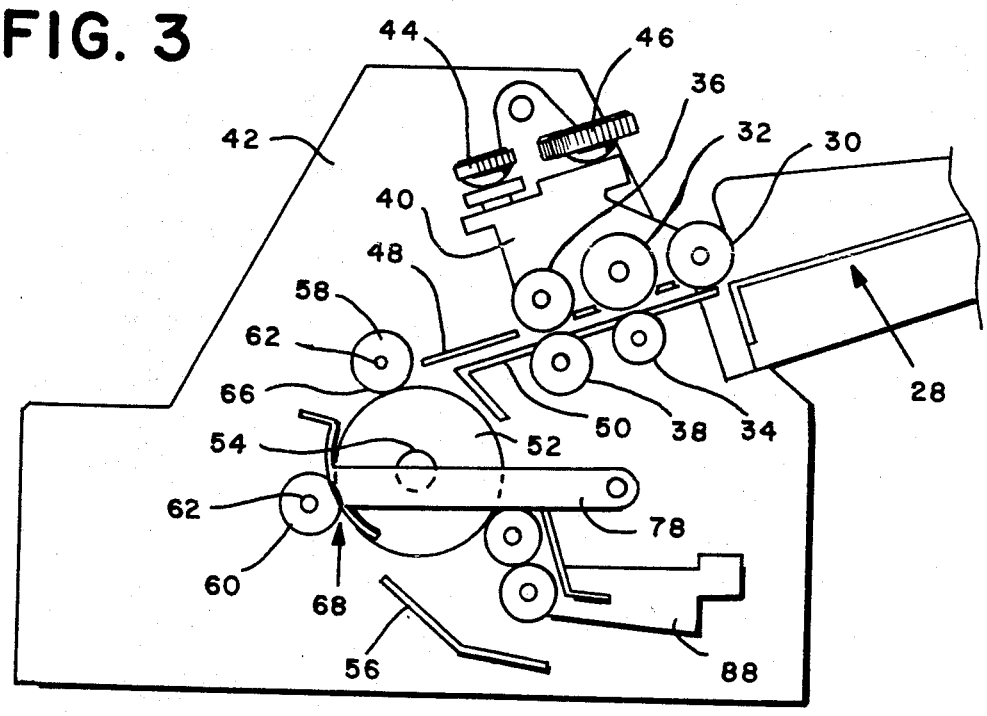

HIGH SPEED ENVELOPE FLAP OPENER

BACKGROUND OF THE INVENTION

The invention relates to an improved apparatus for conditioning an article, such as an envelope, having a bentover flap. More particularly, the invention relates to an improved apparatus for opening envelopes at rates compatible with high speed serial feeding of opened envelopes to a workstation.

In conventional high volume mailrooms utilizing document inserting apparatus, envelopes are delivered to a work station in opened condition and arranged so that sheets or documents may be inserted into the envelope. Thus the envelopes, which are typically furnished by the manufacturer with the flat folded firmly against the body, must be serially opened individually and then serially fed to the workstation with the flap bent back so as to permit access to the interior of the envelope. Conventional envelope-opening devices have worked well in relatively slow mailing systems, but in order to continue to meet mailing deadlines as the volume of mail increases it has become necessary to substantially increase the throughput of the envelope conditions apparatus, U.S. Pat. No. 2,668,053 issued to Bach discloses a two-cycle envelope-opening device in which an envelope is fed edgewise in a first direction, flap edge foremost, along a curved path into abutment against a stop positioned such that the flap passes beyond a stripper plate and then in a second, oppositely-directed movement is fed past the stripper plate which then engages the flap and folds it back as the envelope moves by. This device works well at slower speeds but because of the paper paths which must be sequentially negotiated by the envelopes, any jams which occur normally involve at least two envelopes must come to a complete stop and then reverse direction during the cycle, the possibilities for increased speed are limited. A further nuisance in such prior devices is that two cycles must occur before proper insertion of documents into an envelope is re-established.

U.S. Pat. No. 3,162,435 issued to Rastorguyeff, et. al. addressed and solved some of the problems mentioned above by utilizing a different technique for opening envelope flaps. In this device a flap-intercepting nose of a pivoted member is driven toward the envelope body by the force of the lower edge of the envelope striking a lever arm of the member as the enveloped is transported around a transfer roller. The feeding movement of the envelope against the lever arm causes this nose to slideably engage and fold back the flap. While this device has also worked well at low speeds, it cannot be easily adjusted to accommodate the various thicknesses and stiffnesses of the envelopes available. An even more significant limitation has been found in that in high speed operation using such devices, instances have occurred where the flaps of envelopes have been completely sheared off, apparently because of the increased engaged force of the intercepting edge created by particular combinations of envelope thickness and speed.

SUMMARY OF THE INVENTION

In accordance with the invention, a novel high-speed flap-opening apparatus is used in combination with a relatively large transfer roller having two spaced rollers disposed along the periphery to form two separated nips. The pivotable envelope flap-opener comprises guide means having a lip for engaging the flap of the envelope. The flap-opener is disposed at a first position for receiving an envelope from the first nip. The force of the envelope causes the flap-opener to move to a second position which guides the envelope to the second nip of the envelope. As the flap emerges from the first nip, the lip of the flap-opener engages the flap to bend it back as the envelope passes through the second nip.

It therefore is an object of the present invention to provide a more positive and at the same time more gentle flap-opening device for use with higher speed insertion devices.

It is a further object of the invention to provide a high-speed envelope opener which is operable independently of envelope size, thickness, and shape.

BRIEF DESCRIPTION OF THE DRAWING

Other objects and advantages of the apparatus of the invention will become apparent from the description of the preferred embodiment in the drawing wherein:

FIG. 2 is a perspective view of the operative portion of the envelope flap opening device with the remainder of the machine not shown for ease of illustration;

FIG. 3 is a schematic view of the envelope opening machine illustrating the relationship of the improved flap opener to the other parts of the machine;

DESCRIPTION THE PREFERRED EMBODIMENT

Figure 1:
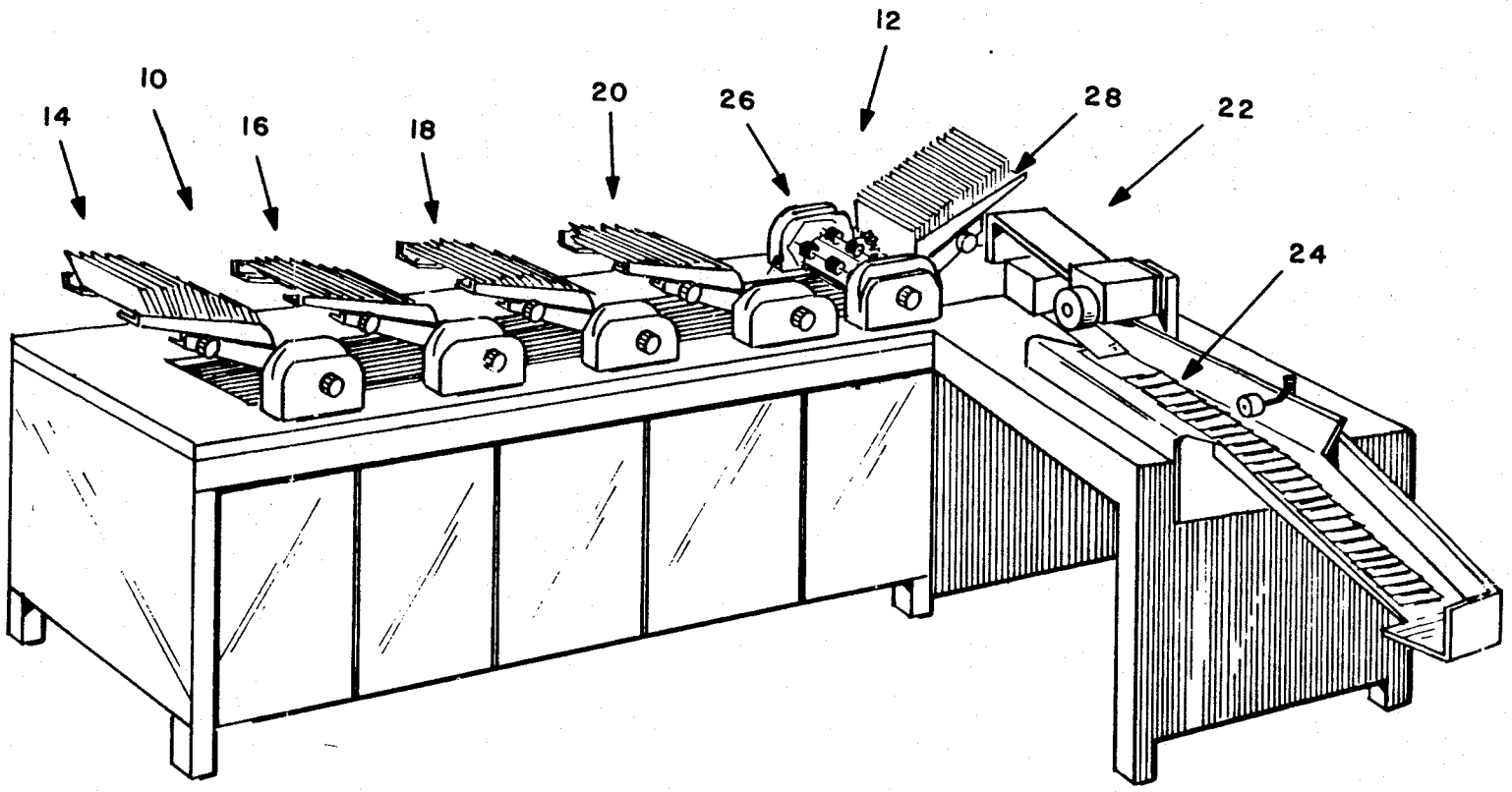
FIG. 1 is a perspective view of a complete mailing system in which an envelope opening apparatus having an improved flap opening device in accordance with the invention may be utilized.

In FIG. 1, a typically configured mailing system is illustrated at 10. Such a system is described for example in U.S. Pat. No. 3,935,429 issued to Branecky, et. al. An envelope feeder apparatus in which the improved flap opening device in accordance with the invention may be utilized is illustrated at 12. The envelope feeder apparatus opens the envelopes and positions them serially at an inserter stop where the documents fed from the document feeders shown at 14, 16, 18, and 20 are inserted into the envelope. The filled envelope is then transported from the envelope feeder 12 to postage meter 22 where postage is applied and from there to power stacker 24. It will be appreciated that other configurations of mailing systems are well known and such envelope feeding devices incorporating the invention described herein may be utilized in configurations other than the one illustrated.

Considering now FIGS. 2 and 3 together, there is shown in simplified schematic form an embodiment of the invention which may be incorporated at the location shown in FIG. 1 generally at 26. Feed roller 30 is disposed in conventional manner in the envelope feeder for engaging and feeding envelopes stacked on the deck 28 to the gap between separator roller 32 and separator stone 34. Downstream from the separator roller are located the demand roller pair 36 and 38. The rollers 30, 32, and 36 are all mounted on block 40 which is suitably adjusted with respect to frame 42 and thus with respect to stone 34 and roller 38 by knurled nuts 44 and 46 shown schematically in FIG. 3. The rollers 30, 32, 36 and 38 are driven in timed sequence in conventional manner, as for example described in the above-cited U.S. Pat. No. 3,935,429 in order to feed envelopes serially through guides 48 and 50 the main or transfer roller 52.

As best seen in FIG. 2, the transfer roller 52, which may be a continuous roller, suitably comprises a plurality of spaced rollers **52*a* through 52*d* spaced on roller shaft 54 which is rotatably driven in conjunction with the feeding of an envelope through the demand rollers and from thence through the guides and around the periphery of the rollers 52*a* through 52*d* onto the ledge 56**.

A plurality of pressure rollers **58*a* through 58*b* and 60*a* through 60*d* are each spaced apart along shaft 62 and shaft 64, respectively. EAch set of pressure rollers thus positioned form a first or entrance nip 66 and a second or exit nip 68 between the pressure rollers and the transfer rollers 52*a* through 52*d***.

The flap-opener device shown generally at 70 comprises an arucate body having depending fingers **72*a* through 72*d* and includes flap opening lip 74. The flap opener device 70 is pivoted about an axis indicated at 76 suitably by arms 78 and 80. Spring 82 anchored to frame 42 (not shown in FIG. 2) biases the flap opening device 70 to its upward or first position. In this position, each of the dependent fingers 72*a* through 72*d* extend into annular grooves 84*a* through 84*d* on rollers 52*a* through 52*d*, respectively. It will be understood that these annular grooves can be spaced at positions other than that shown and that the rollers 52*a* through 52*d* may be of other widths and may be spaced at other predetermined spacings along its axis 64. It will also be appreciated that other widths of depending fingers may be utilized. The arcuate body including the depending fingers is of suitable radius wherein the curvature of the flap-opener 70 corresponds to the circumference of the transfer roller 52 so that in the second or lower position as the envelope is transported between the two sets of pressure rollers, it will be guided about the periphery of the transfer rollers 52*a* through 52*b***.

Figure 4:
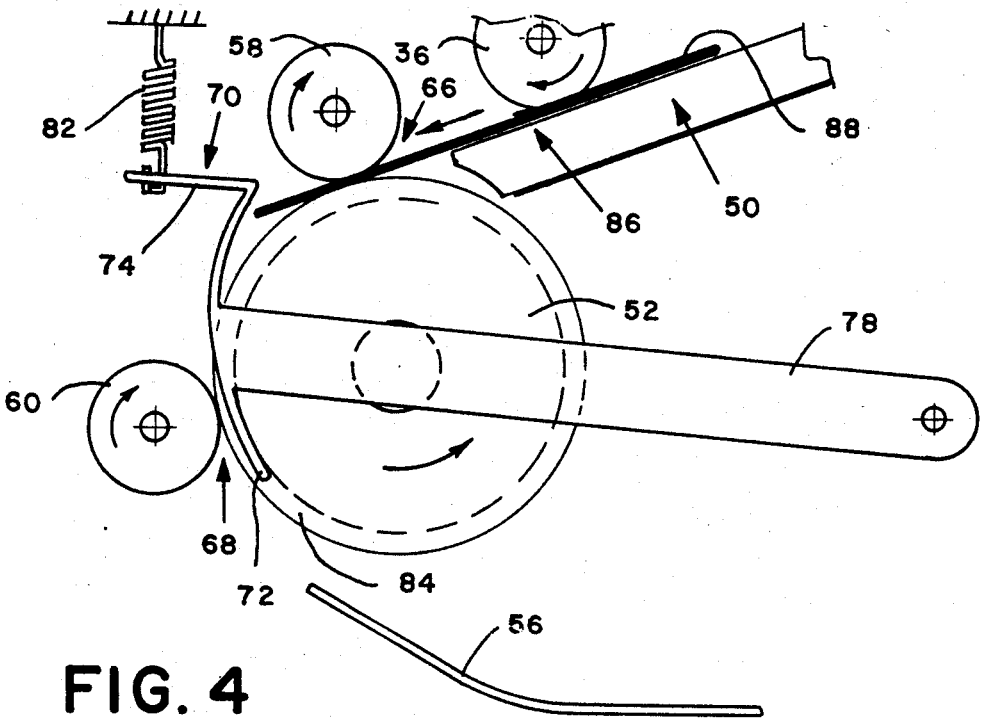
FIG. 4 schematically illustrates the flap opener in its first position.
Figure 5:
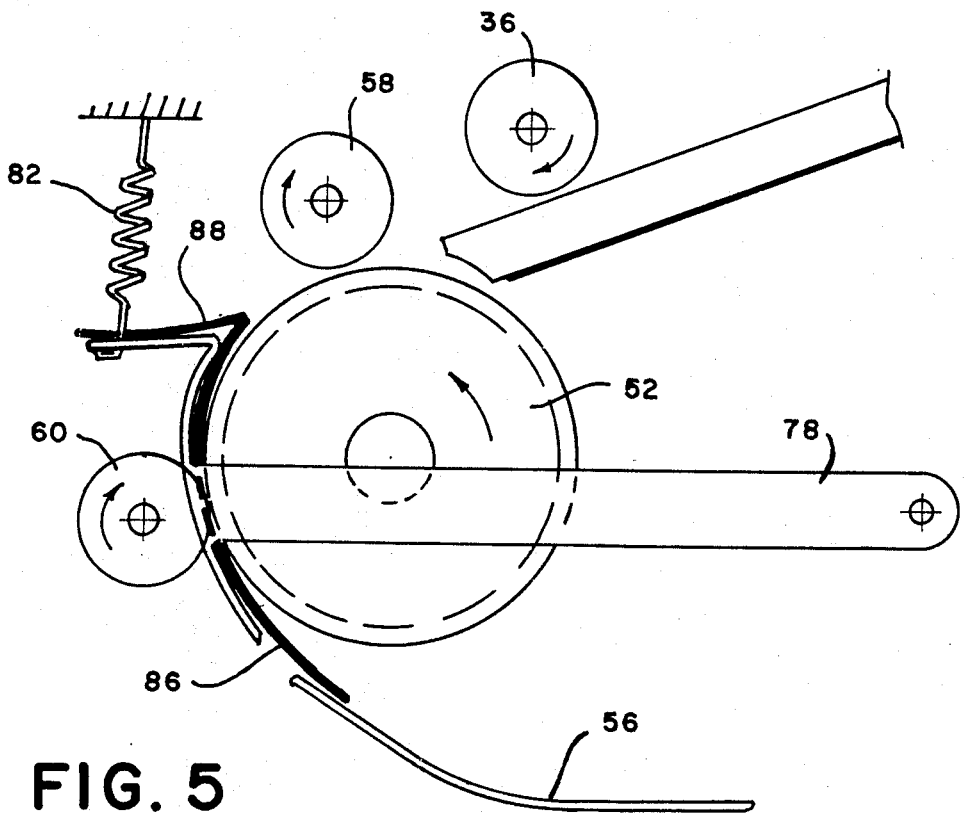
FIG. 5 schematically illustrates the flap opener in a second operating position.
Figure 6:
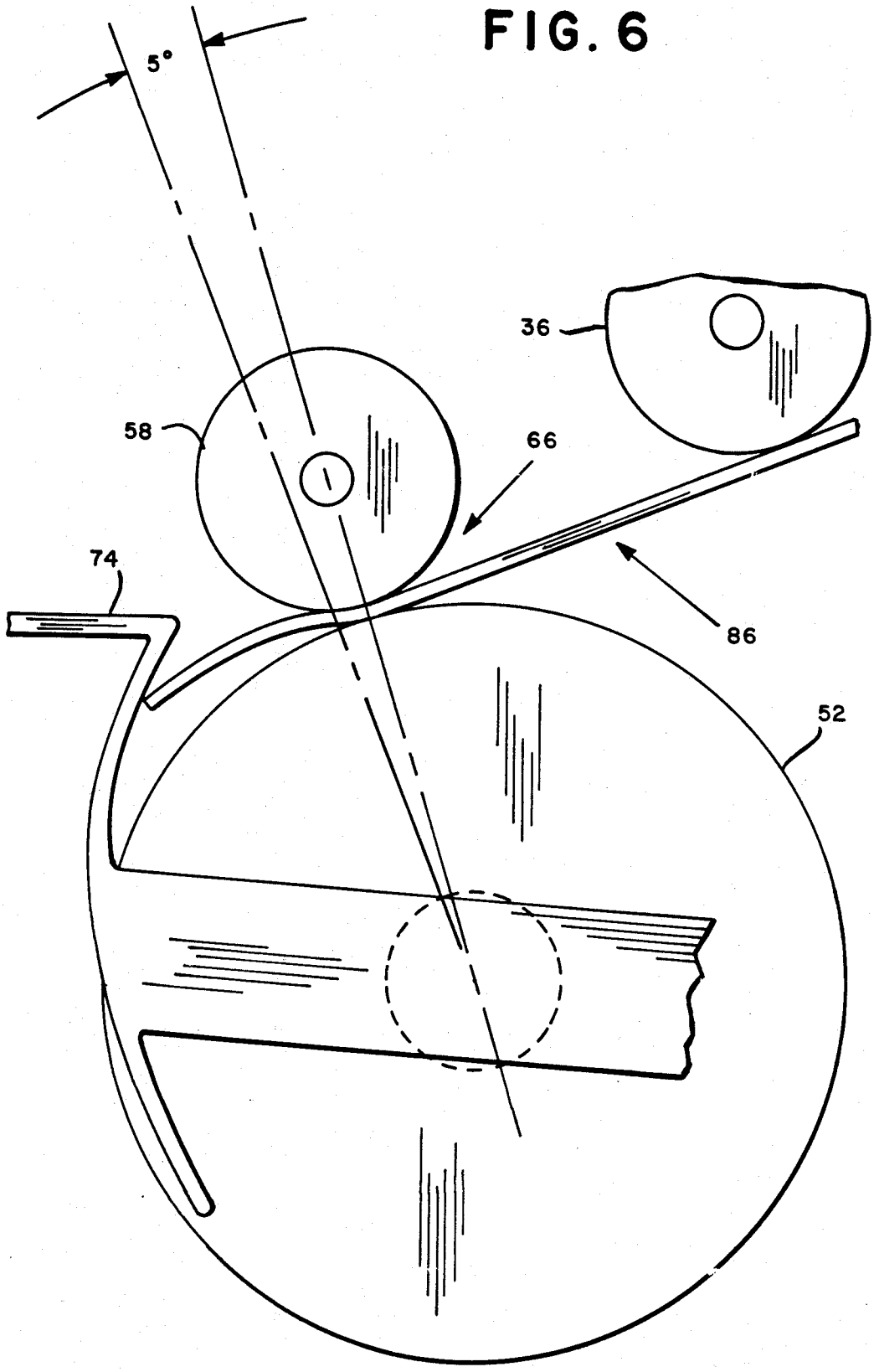
FIG. 6 shows an enlarged view of the location of the nip between the first pressure roller and the transfer roller of the flap opener in accordance with the invention.

The operation of the flap opening device in accordance with the invention is best described in conjunction with the schematic illustrations in FIG. 4 and FIG. 5. The numbers in these figures correspond to those in FIGS. 2 and 3.

An envelope 86 having a closed bent over flap 88 is illustrated being transported along the guide surface 50 under the urging of the demand roller 36. As the demand roller 36 is rotating to urge the envelope 86 forward, the main transfer roller 52 is also being driven at approximately the same peripheral velocity as the envelope speed. The envelope is captured and feeds through the first or entrance nip 66 between the pressure roller 58 and the transfer roller 52 into the space formed between the flap opening device 70 in its first position and the transfer roller 52. As the bottom of the envelope 86 strikes the flap-opener 70, the force of the envelope urges the flap-opener device 70 downward against the upwardly biasing force of the spring 82. At the same time the envelope bends downwardly and continues to be transported on the periphery of the roller 52 now guided by the depending fingers which have moved downwardly and out from the annular groove indicated at 84 and have formed a guiding curving surface about the periphery of the main transfer roller 52 to keep the envelope essentially in place against the roller.

As is shown in FIG. 5, as the envelope is transported on the periphery of roller 52, the flap 88 leaves the nip 66 between pressure roller 58 and transfer roller 52 and is forced outward both by the backward bending of the envelope and the centrifugal forces developing as the envelope travels around the periphery of roller 52. Since the flap is thrust outwardly as it leaves the nip 66, the flap engaging lip 74 of flap-opener 70 which has moved to the second position is in position to engage the flap 88 and to bend it backward as the envelope continues about the periphery of roller 52.

It will be apparent that as the envelope flap continues past the lip 74 and is fed over the ledge 56 that the flap 88 will be bent backward so that as the envelope is ejected through the nip 68 of pressure roller 60 the envelope's flap will be open. Returning now to FIG. 3, it is easily seen that the envelope will be ejected from the nip 68 between ledge 56 and the depressor 88 and from thence can be transported in conventional manner to the envelope insertion stop.

While the positioning of the first pressure roller is not highly critical it has found that, preferably, the first pressure roller 58 should be disposed on the periphery of the transfer roller 52 slightly further upstream than the tangent point at which the envelope would normally contact the surface of the transfer roller 52 in order for the envelope flap to be more positively forced outwardly as the envelope moves about the periphery of roller 52. For best results, it has been found that the pressure roller 58 should be placed approximately 5° (measured angularly of roller 52) from the tangent point. Such positioning provides a reverse curve or in other words a slightly S-shaped bend of the envelope passing through the nip 66.

What is claimed is:

1. In a device for handling articles each of which has a bent-over flap, apparatus for conditioning the flap, comprising:

a transfer roller rotatably driven mounted on a frame;

a first rotatably mounted pressure roller abuttingly disposed against said transfer roller and providing between itself and said transfer roller a first nip for receiving an article having a bent-over flap;

a second pressure roller abuttingly disposed against said transfer roller, said second pressure roller being spaced from said first pressure roller about the periphery of said transfer roller and providing between itself and said transfer roller a second nip for receiving the article; and a pivotable flap-opening means for receiving the article from the first nip, said pivotable flap-opening means being arcuately shaped and having a flap-engaging lip thereon, said pivotably flap-opening means being dynamically pivotable between a first position for receiving the article between itself and the transfer roller and a second positon for guiding the article about said transfer roller to the second nip, wherein the first pressure roller is arranged with respect to said flap-opening means such that the article flexes in a direction opposite from the curvature of the transfer roller as the article exits the first nip and is guided to the second nip, and wherein the flap-engaging lip on said pivotable flap-opening means is arranged for engaging the flap of said article as said pivotable flap-opening means is guiding the article about said transfer roller whereby the flap is opened and bent back by the engagement of the flap with the lip as the article is guided past the lip through the second nip.

2. The device of claim 1 wherein said pivitable flap-opening means pivots about an axis which is located on the opposite side of the transfer roller from pressure rollers.

3. The device of claim 1 wherein said pivotable flap-opening means has fingers for interleaving with annular grooves in the transfer roller so that the article exiting from the first nip is received in the angle between the fingers of the flap-opening means and the periphery of the transfer roller and the article forces said flap-opening means from said first position to said second position.

4. The device of claim 1 further comprising article transport means for conveying articles along a transport plane to said first nip and wherein the first pressure roller is arranged so that the first nip occurs on the periphery of the transfer plan upstream from the tangent point defined by the intersection of the extension of the transport plane with the periphery of the transport roller.

5. The device of claim 4 wherein the first nip is angularly disposed at about five degrees (5°) upstream from said tangent point.

* * * * *

UNITED STATES PATENT AND TRADEMARK OFFICE

CERTIFICATE OF CORRECTION

PATENT NO. : 4,715,164

DATED : December 29, 1987

INVENTOR(S) : Harry E. Luperti et al.

It is certified that error appears in the above-identified patent and that said Letters Patent are hereby corrected as shown below:

| | |
|---|---|
| column 1<br>line 37 | after "envelopes" insert --so that they are difficult to clear and, since the envelopes-- |
| column 2,<br>line 42 | "Description the" should be --Description of the--. |
| column 3,<br>line 9 | "50 the" should be ----50-to the-- |
| column 3,<br>line 21 | "EAch" should be --Each-- |
| column 3,<br>line 26 | "arucate" should be --arcuate-- |
| column 4<br>line 35 | "angularly of" should be --angularly on-- |

UNITED STATES PATENT AND TRADEMARK OFFICE

CERTIFICATE OF CORRECTION

PATENT NO. : 4,715,164

DATED : December 29, 1987

INVENTOR(S) : Harry E. Luperti et al.

It is certified that error appears in the above-identified patent and that said Letters Patent is hereby corrected as shown below:

Column 5 line 6 "pivitable" should be --pivotable--

Signed and Sealed this

Seventh Day of February, 1989

*Attest:*

DONALD J. QUIGG

*Attesting Officer*

*Commissioner of Patents and Trademarks*